United States Patent [19]

Fujita et al.

[11] Patent Number: 4,547,703

[45] Date of Patent: Oct. 15, 1985

[54] THIN FILM ELECTROLUMINESCENT ELEMENT

[75] Inventors: Yosuke Fujita, Ashiya; Takao Tohda, Ikoma; Tomizo Matsuoka, Neyagawa; Atsushi Abe, Ikoma; Tsuneharu Nitta, Katano, all of Japan

[73] Assignee: Matsushita Electric Industrial Co., Ltd., Kadoma, Japan

[21] Appl. No.: 576,394

[22] PCT Filed: May 26, 1983

[86] PCT No.: PCT/JP83/00164

§ 371 Date: Jan. 26, 1984

§ 102(e) Date: Jan. 26, 1984

[87] PCT Pub. No.: WO83/04339

PCT Pub. Date: Dec. 8, 1983

[30] Foreign Application Priority Data

May 28, 1982 [JP] Japan ..... 57-91594
Jun. 3, 1982 [JP] Japan ..... 57-95430

[51] Int. Cl.[4] ..... H05B 33/12

[52] U.S. Cl. ..... 313/509; 428/690; 428/917

[58] Field of Search ..... 428/690, 691, 917; 250/327.2; 313/509

[56] References Cited

U.S. PATENT DOCUMENTS 3,054,919 9/1962 Lehmann ..... 428/690
3,129,108 4/1964 Katona ..... 428/917 X
4,132,919 1/1979 Maple ..... 428/690 X
4,225,653 9/1980 Brixner ..... 428/690
4,387,141 6/1983 Patten ..... 428/690
4,416,933 11/1983 Antson et al. ..... 428/917 X

FOREIGN PATENT DOCUMENTS 1543233 3/1979 Japan ..... 428/917
798503 7/1958 United Kingdom .

*Primary Examiner*—George F. Lesmes
*Assistant Examiner*—Nancy A. B. Swisher
*Attorney, Agent, or Firm*—Spencer & Frank

[57] ABSTRACT

In a thin film electroluminescent element comprising a phosphor thin film, a dielectric thin film disposed on at least one of the surfaces of the phosphor thin film and electrodes for applying a voltage across the thin films, the aforementioned dielectric thin film is formed of a dielectric material expressed by a general formula of $AB_2O_6$ (where A represents a divalent metal element and B represents a pentavalent metal element). By employing the dielectric material, the voltage for driving a thin film electroluminescent element can be lowered without decreasing the brightness of the element. Further, by using a composite dielectric thin film in which the dielectric thin film expressed by the aforementioned general formula $AB_2O_6$ is laminated with a dielectric thin film which is not susceptible to dielectric breakdown of self-healing type, the composite dielectric thin film is made susceptible to the dielectric breakdown of self-healing type. Additionally, the value of product of the dielectric breakdown field intensity and dielectric constant is increased to obtain a thin film electroluminescent element having excellent characteristics.

11 Claims, 6 Drawing Figures

(a)

(b)

(a)

(b)

THIN FILM ELECTROLUMINESCENT ELEMENT

This invention relates to a thin film luminescent element which produces luminescence under application of an electric field.

BACKGROUND OF THE INVENTION

In a thin film EL (electroluminescent) element which produces luminescence in response to the application of an electric field, increased brightness is attempted to be attained by sandwiching a phosphor thin film, onto which one or both surfaces thereof is deposited a dielectric thin film, between two electrode layers. The element for which the dielectric thin film is deposited on one surface of the phosphor thin film is characterized by a simplified structure and a low driving voltage. The element for which both surfaces of the phosphor thin film layer have dielectric thin films deposited thereon, respectively, is advantageous in that it is less easy for dielectric breakdown to occur and that brightness is significantly increased. It is known to use ZnS, ZnSe, $ZnF_2$ or the like added with an activator for the phosphor material. In particular, in the case of an element employing phosphor which is composed of ZnS as the host material and contains Mn as the activator for light emission, brightness in the range of 3500 to 5000 cd/m$^2$ at maximum is attained. As the typical dielectric material, $Y_2O_3$, SiO, $Si_3N_4$, $Al_2O_3$, $Ta_2O_5$ and the like may be used. The layer of ZnS has a thickness in the range of 500 to 700 nm and a dielectric constant of about 9. The thickness of the dielectric film is in the range of 400 to 800 nm and its dielectric constant is in the range of 4 to 25.

When the element is driven by using an AC voltage, the voltage applied across the element is divided between the layer of ZnS and the dielectric thin film, wherein about 40% to 60% of the voltage applied across the electrodes is found in the layer of ZnS. The voltage required for producing brightness thus appears to be higher. In the case of the element having both surfaces provided with dielectric thin films, brightness is produced by applying a voltage of 200 V or greater at a frequency on the order of KHz at the present state of art. Such a high voltage imposes a great load on the driving circuit, requiring a special, expensive, integrated circuit (IC) capable of withstanding the high voltage.

In this connection, it is proposed to use as the dielectric thin film a thin film which contains $TbTiO_3$, $Pb(Ti_{1-x}Zr_x)O_3$ or the like as its main component and exhibits a high dielectric constant, for lowering the driving voltage. Although this type thin film has a dielectric constant (hereinafter represented by $\epsilon_\gamma$) as high as 100 or more, electric field intensity at which the dielectric breakdown occurs (hereinafter represented by $E_b$) is as low as 0.5 MV/cm, which means that the film thickness be significantly increased when compared with that of the heretofore used dielectric material. In the case of an element designed for high brightness, it is required that the thickness of the ZnS-layer be on the order of 0.6 μm. Further, from the stand point of reliability of the element, the aforementioned dielectric thin film has to be formed in thickness not smaller than 1.5 μm. When temperature of the substrate is high, increase in film thickness results in the growth of particles within the film. As the consequence, a film becomes turid and white, decreasing light transmission. In an EL element in which such white-turbid film is employed and which is arranged in an X-Y matrix configuration, even a non-selected pixel will scatter light emitted by other pixels, causing the troublesome problem of cross-talk.

DETAILED DESCRIPTION OF THE EMBODIMENTS

Figure 1:
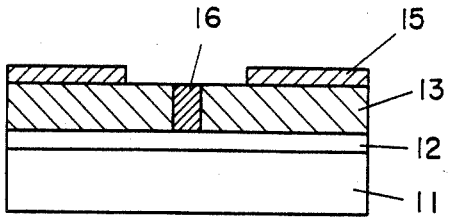
FIG. 1 provides sectional and top views illustrating a self-healing type dielectric breakdown in a dielectric layer, and FIG. 2 provides sectitonal and top views illustrating a dielectric breakdown in a dielectric layer which is not of the self-healing nature.
Figure 1:
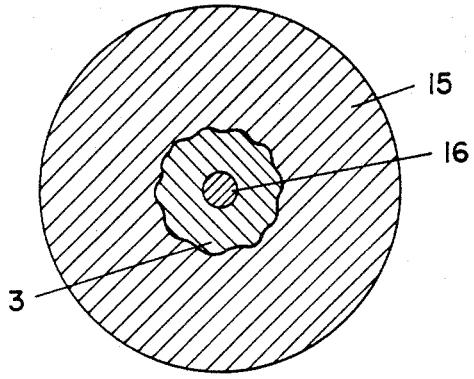

With the present invention, it is intended to solve the problems described hereinbefore. It is proposed according to the invention to use a dielectric layer which has a composition generally expressed by $AB_2O_6$ where A represents a divalent metal element, B represents a pentavalent metal element and O represents oxygen, which exhibits high $\epsilon_\gamma$ and $E_b$ values, to thereby allow the driving voltage to be lowered without decreasing the brightness when compared with hitherto known thin film EL elements.

In an AC-driven thin film EL element, the voltage applied across the dielectric layer is represented by the product $t_i \cdot E_i$, where $t_i$ represents the film thickness of the dielectric thin film and $E_i$ represents the electric field intensity applied to the dielectric thin film. The voltage applied across the phosphor thin film becomes more effective as the value of $t_i \cdot E_i$ is decreased. It is safe to say that $t_i$ is in inverse proportion to $E_b$ of the dielectric thin film in order that the element can operate stably without undergoing dielectric breakdown. Among $E_i$, the electric field intensity $E_Z$ in the phosphor thin film, the dielectric constant $\epsilon_Z$ of the phosphor thin film and $\epsilon_\gamma$ of the dielectric thin film, a relationship of $E_i = E_z \cdot \epsilon_z / \epsilon_\gamma$ applies. $E_i$ is in inverse proportion to $\epsilon_\gamma$, providing $E_Z$ and $\epsilon_Z$ are constant. Accordingly, it can be said that $t_i \cdot E_i$ is approximately in inverse proportion to the product of $E_b$ and $\epsilon_r$. The dielectric thin film is more advantageous with $E_b \cdot \epsilon_\gamma$ of higher value.

The dielectric thin film defined by the general formula of $AB_2O_6$ and used according to the teaching of the present invention, exhibits $E_b \cdot \epsilon_\gamma$ of a greater value than that of the heretofore used material and is preferable as the dielectric thin film for the EL element. In connection with the above formula, A represents a divalent metal element such as Pb, Sn, Zn, Cd, Ba, Sr, Ca and Mg, and B represents Ta or Nb. A mass of a compound of these elements exhibits $\epsilon_\gamma$ of a great value. By way of example, it is reported that the $\epsilon_\gamma$ of $PbNb_2O_6$ is 300, the $\epsilon_\gamma$ of $PbTa_2O_6$ is 300 and the $\epsilon_\gamma$ of $(Pb_{0.55}Sr_{0.45})Nb_2O_6$ is 1600. In the case of a thin film, it is difficult to realize an $\epsilon_\gamma$ of the same value as a mass of the same material. However $\epsilon_\gamma$ of a value not less than 40 can be easily realized in a thin film fabricated by a sputtering process. In addition, $E_b$ of the thin film is as high as $2\times10^6$ V/cm or more. The value of $E_b\cdot\epsilon_\gamma$ of such thin film is not less than $80\times10^6$ V/cm. It will be seen that the thin film formed from the compound mentioned above is excellent when compared with the material used heretofore such as, for example, $Y_2O_3$, $Al_2O_3$ and $Si_3N_4$ whose values of $E_b\cdot\epsilon_\gamma$ are about $50\times10^6$ V/cm, $30\times10^6$ V/cm and $70\times10^6$ V/cm, respectively. In the compound expressed by the general formula of $AB_2O_6$, Nb and Ta, which are most stable in pentavalence, are preferrable as the element represented by B. Among the divalent elemnts represented by A, Sr, Ba and Pb are very preferable. Above all, $PbTa_2O_6$, and $PbNb_2O_6$ where the element represented by A is Pb, which have the values of $E_b\cdot\epsilon_\gamma$ of $150\times10^6$ V/cm and $120\times10^6$ V/cm, respectively, provide very excellent thin film materials for the EL element. The thin film is formed by an RF sputtering method with a ceramic target. As the temperature of the substrate on which the thin film is to be formed is increased, the value of $\epsilon_\gamma$ of the thin film as formed becomes correspondingly greater. The dielectric breakdown field intensity $E_b$ assumes a substantially constant value when the temperature of the substate is lower than about 400° C. and is gradually decreased when the substrate temperature is raised to a higher temperature. The value of $E_b\cdot\epsilon_\gamma$ becomes greatest when the temperature of the substrate is approximately at 400° C. In the temperature range mentioned above, no adverse influence will be exerted on the phosphor thin film. Besides, glass may be used as the material for the substrate without giving rise to a problem such as thermal deformation of the substrate. Moreover, no white turbidity will be produced due to the growth of particles.

Unless the temperature of the substrate is sufficiently high, the thin film will be found to be amorphous when investigated by means of X-ray diffraction. Through chemical analysis and phosphor X-ray analysis, it has been ascertained that the thin film has a composition substantially coinciding with the general formula of $AB_2O_6$.

In general, various defects are produced in the thin film by pinholes, dusts and the like. When a voltage is applied to the dielectric thin film, dielectric breakdown is likely to take place at the defective locations at a lower voltage rather than the non-defective locations.

Figure 2:
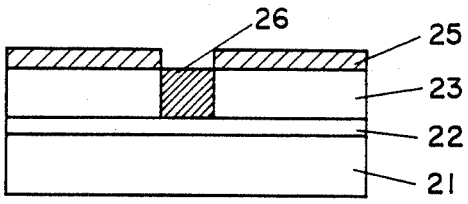
Figure 2:
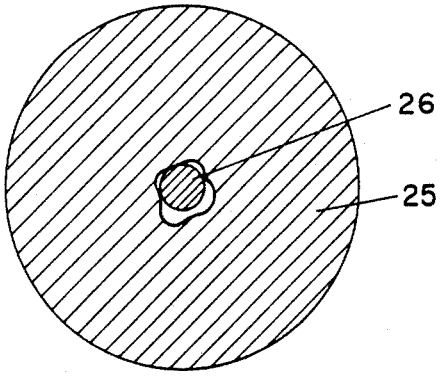

The dielectric breakdown may generally be classified into two types. One is the dielectric breakdown of self-healing type. More specifically, referring to FIG. 1, an upper electrode 15 overlying a location 16 where the dielectric breakdown has occurred is eliminated from an area of several tens of $\mu$m under discharging energy, wherein the upper electrode 15 is disconnected from a lower electrode 12. The dielectric breakdown occurring in the dielectric thin film of the composition expressed by the general formula $AB_2O_6$, where A represents a divalent metal element and B represents a pentavalent metal element, is of this type. The numeral 11 denotes a substrate, and 13 denotes a dielectric thin film which is the dielectric breakdown of the self-healing type. As is shown in FIG. 2, the upper electrode 25 is eliminated only to such a small degree that the upper electrode 25 is electrically short-circuited to the lower electrode 22 on substrate 21 through a hole 26 formed by the dielectric breakdown in dielectric thin film 23 which is not susceptible to dielectric breakdown of the self-healing type. When the voltage continues to be applied in this state, the dielectric breakdown may spread over the whole dielectric film. A dielectric thin film containing perovskite type titanate as a main component is of this type.

As the thickness of the upper electrode is decreased, the dielectric breakdown is less likely to occur. However, if the thickness is decreased excessively, resistance of the electrode is increased, to a disadvantage. Accordingly, the electrode should have a thickness of several tens of nm's at minimum. Electrode material such as Au, Zn, Al and others is most likely to undergo the dielectric breakdown of the self-healing type. However, there exist some dielectric thin films in which no dielectric breakdown of the self-healing type takes place even when the electrode is of Au, Zn, Al or the like having a thickness of several tens of nm's. This dielectric breakdown is ascribable to the inherent nature of the material. Although the reason can not be explained, it appears that the aspect of the arc-discharge which is produced upon dielectric breakdown, which is effective to eliminate the material of the upper, differs between a film in which dielectric breakdown of the self-healing type will occur and a film whose dielectric breakdown is not of the self-healing nature.

In case a dielectric thin film whose dielectric breakdown is of the self-healing type is used as the dielectric thin film formed on the phosphor layer of an AC-driven thin film EL element, the dielectric breakdown occurring at the defective portion is of the self-healing type. The material of the upper electrode is eliminated over an area of several tens of um's. Since an eliminated pinhole can not be visibly recognized, the dielectric breakdown of the self-healing type presents no practical problem. Since the dielectric thin film of the composition expressed by the general formula of $AB_2O_6$ (where A represents a divalent metal element and B represents a pentavalent metal element) is susceptible to the dielectric breakdown of this type, it is preferred as the dielectric thin film for the AC-driven thin film EL element in respect to dielectric breakdown. On the other hand, when the dielectric film whose dielectric breakdown is not of the self-healing type is formed on the phosphor layer of the AC-driven thin film EL-element, a dielectric breakdown occurring at the defective portion is of the second mentioned type. The dielectric breakdown is likely to spread over the whole pixel, producing a visible deficiency. In the case of an X-Y matrix array, a line defect will result. Although the thin film of perovskite type titanate can be easily fabricated with a large value of $\epsilon_\gamma$ and exhibit $E_b$ of a large value at the locations where no defects due to pinholes and dusts are present, this film is not susceptible to dielectric breakdown of the self-healing type. In particular, in the case of a thin film of strontium titanate or barium titanate having $\epsilon_\gamma$ of a great value, the dielectric breakdown of the self-healing type occurs with difficulty, these thin films were not used for the AC-driven thin film EL element. However, when the dielectric thin film of the composition expressed by the general formula of $AB_2O_6$ mentioned above is formed on a thin film of the above mentioned type, the dielectric breakdown occurring due to pinholes and dusts is advantageously of a self-healing nature. In this way, by using a composite dielectric film formed by superimposing a dielectric thin film having a larger value of $E_b\cdot\epsilon_\gamma$ than the film expressed by the general formula of $AB_2O_6$, and not being susceptible to the self-healing type of dielectric breakdown, and the aforementioned dielectric thin film and that expressed by the general formula of $AB_2O_6$ being superimposed onto each other, a dielectric breakdown of the composite film takes place in the form of the self-healing breakdown, while an $E_b \cdot \epsilon_\gamma$ of a larger value than that of the aforementioned dielectric thin film represented by the general formula of $AB_2O_6$ can be assured. It is desirable that the $E_b \cdot \epsilon_\gamma$ of a dielectric thin film which is not susceptible to self-healing type dielectric breakdown is not smaller than $80 \times 10^6$.

Next, exemplary embodiments of the present invention will be described by referring to the drawings.

Figure 3:
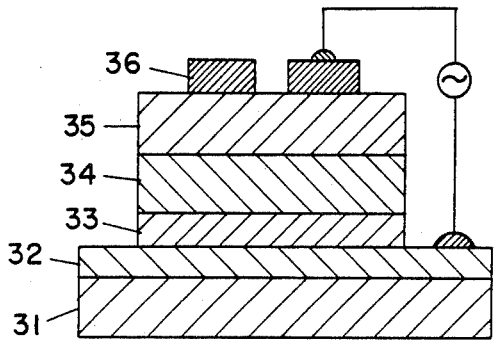
FIG. 3 is a sectional view of a thin film electroluminescent element shown for the purpose of comparison with the element according to the invention.
Figure 4:
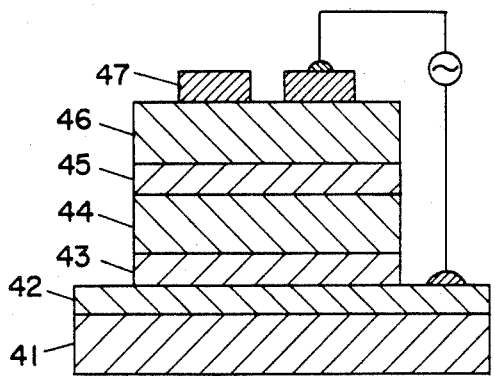
FIG. 4 is a sectional view showing a thin film electroluminescent element according to an exemplary embodiment of the present invention.

For facilitating understanding, the description will be made in conjunction with a comparative example. FIG. 3 shows the comparative example, and FIG. 4 shows an exemplary embodiment of the present invention. As is apparent from the drawings, $Y_2O_3$-films 33 and 43, each of 40 nm in thickness, were formed by an electron beam evaporating method on glass substrates 31 and 41 deposited with transparent electrodes 32 and 42 of ITO (indium tin oxide), respectively. Subsequently, phosphor layers 34 and 44 of ZnS:Mn were formed through simultaneous evaporation of ZnS and Mn. Film thickness is 600 nm. Heat treatment was carried out at 580° C. in vacuum for one hour. The elements were divided into five elements, one of which was used as a specimen for comparison, and a $Y_2O_3$-film 35 of 400 nm thick was formed, as is shown in FIG. 3. On the other hand, the element 2 was formed with a $Ta_2O_5$-film 45 of 30 nm in thickness for the protection of ZnS:Mn by an electron beam evaporating method, as is shown in FIG. 4, in accordance with an embodiment of the present invention. Subsequently, a film 46 of $PbNb_2O_6$ was formed through magnetron RF sputtering by using a ceramic of $PbNb_2O_6$ as a target. The atmosphere for the sputtering contained $O_2$ and Ar at the ratio of 1:4 at a pressure of 0.6 Pa. The temperature of the substrate was 420° C. and the film thickness was 700 nm. According to another embodiment of the present invention, the element 3 was formed with a film of $PbTa_2O_6$ in a thickness of 700 nm on the same conditions as in the case of the element 2, except that a target of $PbTa_2O_6$ was employed in place of $PbNb_2O_6$.

In accordance with still another embodiment of the present invention, the element 4 was formed with a film of $BaTa_2O_6$ in a thickness of 500 nm on the same conditions as in the case of the element 2, except that $BaTa_2O_6$ was used in place of $PbNb_2O_6$ as the target.

According to a further embodiment of the present invention, the element 5 was formed with a film of $SrTa_2O_6$ in a thickness of 450 nm on the same conditions as is the case of the element 2, except that $SrTa_2O_6$ was used in place of $PbNb_2O_6$ as the target.

The $PbNb_2O_6$-film, the $PbTa_2O_6$-film, the $BaTa_2O_6$-film and the $SrTa_2O_6$-film fabricated under the aforementioned conditions have characteristic $E_b$'s of $2.2 \times 10^6$ V/cm, $2.6 \times 10^6$ V/cm, $5.1 \times 10^6$ V/cm and $5.6 \times 10^6$ V/cm, respectively, and $\epsilon_\gamma$'s of 70, 48, 27 and 25, respectively.

As is shown in FIGS. 3 and 4, thin films of Al were deposited through vaporization to form light reflecting electrodes 36 and 47.

Each of the EL elements fabricated in the manner described above was driven by applying a sine wave voltage of a frequency of 5 KHz across the electrodes. The voltage at which brightness was substantially saturated in the stable state was 150 V in the case of the element 1, 100 V in the case of the element 2, 110 V in the case of the element 3, 125 V in the case of the element 4 and 125 V in the case of the element 5. The saturated brightness was about 3000 cd/m$^2$ in all of the five elements.

Figure 5:
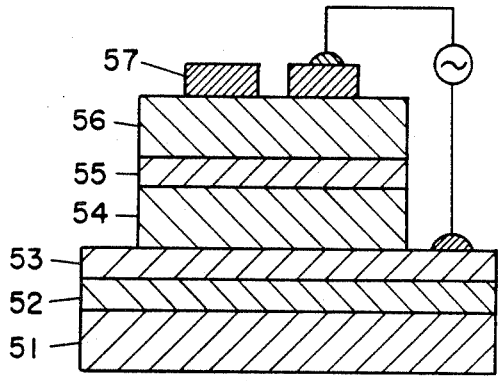
FIGS. 5 and 6 are sectional views showing, respectively, other exemplary embodiments of the thin film electroluminescent element according to this invention.

Next, an embodiment of this invention according to which an AC-driven thin film EL element having a dielectric layer only on one surface of a phosphor layer and in which tungsten bronze type composite oxide film is employed will be described by referring to FIG. 5. A ZnO-film 53 having a thickness of 50 nm was formed by a sputtering method on a glass substrate 51 deposited with a transparent electrode 52 of ITO. The film 53 of ZnO has a resistivity of $8 \times 10^{-3}$ Ω·cm and serves as a second electrode layer for preventing diffusion of In and Sn into ZnS from the transparent electrode 52 of ITO. Subsequently, ZnS and Mn were simultaneously evaporated to form a phosphor layer 54 of ZnS:Mn in thickness of 450 nm. Heat treatment was conducted at 580° C. in vacuum for an hour. Further, a film 55 of $Y_2O_3$ having thickness of 20 nm was formed by an electron beam evaporating method for protecting the phosphor layer 54 of ZnS:Mn. Subsequently, a $PbNb_2O_6$-film 56 was formed by a magnestron RF sputtering method by using ceramic of $PbNb_2O_6$ as a target. Composition of the sputtering atmosphere was $O_2$:Ar=1:1 (in volume ratio), and the pressure thereof was 1.3 Pa. The temperature of the substrate was 320° C. and the film thickness was 500 nm. The film 56 of $PbNb_2O_6$ fabricated on the conditions mentioned above has characteristic $E_b$ of $2.5 \times 10^6$ V/cm and $\epsilon_\gamma$ of 56. Finally, an Al-thin film 57 was formed through evaporation as a light reflecting electrode.

The EL element manufactured in the manner described above was driven by applying a sine wave voltage of 5 KHz between the electrodes. Brightness was substantially saturated at about 70 V. In the stable state, brightness was 1900 cd/m$^2$.

A further embodiment of this invention will be described with the aid of FIG. 6.

Figure 6:
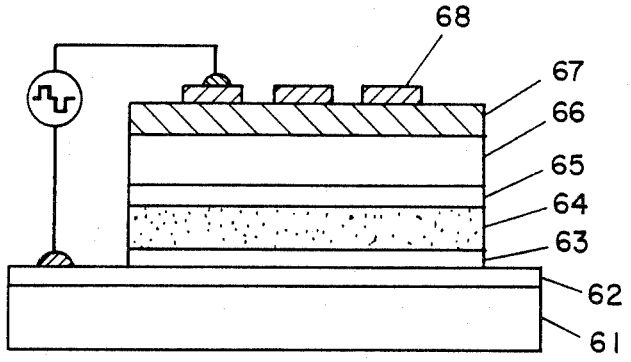

As is shown in FIG. 6, a glass substrate 61 having a transparent electrode 62 of ITO was deposited with a $Y_2O_3$-film 63 in a thickness of 40 nm through electron beam evaporation. Subsequently, a phosphor layer 64 of ZnS:Mn was formed in a thickness of 1.0 μm by simultaneously evaporating ZnS and Mn through vacuum vapor deposition. Heat treatment was conducted at 580° C. in vacuum for one hour. Thereafter, a $Ta_2O_5$-film 65 was deposited in a thickness of 40 nm through electron beam evaporation for protecting the film of ZnS:Mn. The element was divided into two, one of which was deposited with a $SrTiO_3$-film in a thickness of 1.4 μm while the other was deposited with a $BaTiO_3$-film in thickness of 1.6 μm by a magnetron RF sputtering method. A mixed gas of $O_2$ and Ar was used as the sputtering gas at pressure of $8 \times 10^{-1}$ Pa. The temperature of the substate at that time was 420° C. Additionally, a $PbNb_2O_6$-film 67 was deposited in a thickness of 0.4 μm by a magnetron RF sputtering method. A mixed gas containing $O_2$ and Ar at the ratio of 1 to 1 was used as the sputtering gas at a pressure of 0.6 Pa. A sintered body of $PbNb_2O_6$ was used as the target. The temperature of the substate was 380° C. A film 68 of Al was deposited in thickness of 70 nm to form the upper electrode. A voltage was applied between the electrodes of the thin film EL element thus manufactured and the applied voltage was progressively increased. Before brightness was produced, dielectric breakdowns of small degree occurred at defective portions to form holes in diameter of about 30 μm in the Al-film 68 by elimination of the film material. The dielectric breakdowns were all of the self-healing type. The number of the breakdowns was $0.5/cm^2$ in both elements. When the elements were driven by applying an AC pulse voltage of 5 KHz. Both elements were driven into the state in which brightness was substantially saturated when zero-to-peak voltage of about 230 V was applied. The brightness was about 7000 $cd/m^2$.

As will be appreciated from the foregoing, the thin film electroluminescent element according to the invention can be operated stably with a low driving voltage.

We claim:

1. A thin film electroluminescent element comprising a phosphor thin film, a dielectric thin film disposed on at least one surface of said phosphor thin film, and electrodes for applying a voltage across said films, wherein said dielectric thin film comprises a dielectric material subject to dielectric breakdown of the self-healing type having a composition expressed by the general formula of $AB_2O_6$, where A is at least one divalent metal element selected from the group consisting of Pb, Sn, Mg, Ca, Sr, Ba, Zn and Cd, and B is at least one pentavalent metal element selected from the group consisting of Ta and Nb, wherein the product $E_b \cdot \epsilon_\gamma$ of the dielectric breakdown electric field intensity $E_b$ and dielectric constant $\epsilon_\gamma$ for the dielectric thin film is greater than or equal to $80 \times 10^6$ V/cm.

2. A thin film electroluminescent element according to claim 1, wherein the divalent metal element A is at least one selected from a group consisting of Pb, Sr and Ba.

3. A thin film electroluminescent element according to claim 1, wherein the divalent metal element A is Pb.

4. A thin film electroluminescent element comprising a phosphor thin film, a dielectric thin film disposed on at least one surface of said phosphor thin film, and electrodes for applying a voltage across said films, wherein said dielectric thin film comprises a dielectric material having a composition expressed by the general formula of $AB_2O_6$, wherein A is at least one divalent metal selected from a group consisting of Pb, Sn, Mg, Ca, Sr, Ba, Zn and Cd, and B is at least one pentavalent metal selected from the group consisting of Ta and Nb.

5. A thin film electroluminescent element according to claim 4, wherein the divalent metal element A is at least one selected from a group consisting of Pb, Sr and Ba.

6. A thin film electroluminescent element according to claim 5, wherein the divalent metal element is Pb.

7. A thin film electroluminescent element comprising a phosphor thin film, a dielectric thin film disposed on at least one surface of said phosphor thin film, and electrodes for applying a voltage across said films, wherein the dielectric thin film comprises a first dielectric thin film layer which is subject to dielectric breakdown of the self-healing type, expressed by the general formula of $AB_2O_6$ where A represents a divalent metal element selected from the group consisting of Pb, Sn, Mg, Ca, Sr, Ba, Zn and Cd, and B represents a pentavalent metal element selected from the group consisting of Ta and Nb, and a second dielectric thin film layer superimposed thereon, wherein said second dielectric thin film has a product $E_b \cdot \epsilon_\gamma$ of dielectric breakdown electric field intensity $E_b$ and dielectric constant $\epsilon_\gamma$ not smaller than $80 \times 10^6$ V/cm and is not susceptible to a dielectric breakdown of the self-healing type.

8. A thin film electroluminescent element according to claim 7, wherein the second dielectric thin film, not susceptible to the dielectric breakdown of the self-healing type, is formed from a dielectric material containing perovskite type titanate as a main component.

9. A thin film electroluminescent element according to claim 4, wherein the divalent metal element A is at least one selected from a group consisting of Pb, Sr and Ba.

10. A thin film electroluminescent element according to claim 9, wherein the divalent metal element is Pb.

11. A thin film electroluminescent element according to claim 7, wherein the divalent metal element A is at least one selected from a group consisting of Pb, Sr and Ba.

* * * * *